US009592427B2

(12) United States Patent
Kitazaki et al.

(10) Patent No.: US 9,592,427 B2
(45) Date of Patent: Mar. 14, 2017

(54) BALL FOR BALL GAME

(71) Applicant: The Yokohama Rubber Co., LTD., Minato-ku, Tokyo (JP)

(72) Inventors: Tsuyoshi Kitazaki, Hiratsuka (JP); Hiroshi Saegusa, Hiratsuka (JP)

(73) Assignee: The Yokohama Rubber Co., LTD. (JP)

( * ) Notice: Subject to any disclaimer, the term of this patent is extended or adjusted under 35 U.S.C. 154(b) by 0 days.

(21) Appl. No.: 14/401,506

(22) PCT Filed: May 13, 2013

(86) PCT No.: PCT/JP2013/003057
§ 371 (c)(1),
(2) Date: Nov. 14, 2014

(87) PCT Pub. No.: WO2013/172015
PCT Pub. Date: Nov. 21, 2013

(65) Prior Publication Data

US 2015/0087443 A1 Mar. 26, 2015

(30) Foreign Application Priority Data

May 16, 2012 (JP) ..... 2012-112184
Dec. 13, 2012 (JP) ..... 2012-271923

(51) Int. Cl.
*A63B 43/00* (2006.01)
*A63B 37/00* (2006.01)
(Continued)

(52) U.S. Cl.
CPC ..... *A63B 43/004* (2013.01); *A63B 37/0003* (2013.01); *A63B 37/0038* (2013.01);
(Continued)

(58) Field of Classification Search
CPC ..... A63B 24/0021; A63B 2220/35; A63B 2220/36; A63B 2220/89
See application file for complete search history.

(56) References Cited

U.S. PATENT DOCUMENTS 4,381,109 A * 4/1983 Von Kohorn ..... A63B 43/004 40/327
4,433,840 A * 2/1984 Van Auken ..... A63B 43/004 473/570
(Continued)

FOREIGN PATENT DOCUMENTS

JP S50-104755 8/1975
JP H05-79573 10/1993
(Continued)

OTHER PUBLICATIONS

International Search Report for International Application No. PCT/JP2013/003057, dated Jun. 18, 2013, 6 pages, Japan.

*Primary Examiner* — John E Simms, Jr.
(74) *Attorney, Agent, or Firm* — Thorpe North & Western

(57) ABSTRACT

A golf ball includes a spherical body and intersection surfaces. The intersection surfaces intersect with a spherical surface centered on the center of the spherical body, and are formed as conductive intersection surfaces having conductivity. The spherical surface is formed to have a smaller diameter than a diameter of the spherical body, and the conductive intersection surface is formed on an outer side in the radial direction of the spherical surface. The intersection surfaces intersect with a spherical surface centered on the center of the spherical body, and are formed as conductive intersection surfaces having conductivity. The conductive intersection surface is formed by both side surfaces of the annular body, and so the conductive intersection surface is
(Continued)

formed to be continuous around the entire circumferential length of the spherical surface in the circumferential direction.

20 Claims, 11 Drawing Sheets

(51) Int. Cl.
*A63B 45/00* (2006.01)
*A63B 47/00* (2006.01)
*A63B 24/00* (2006.01)

(52) U.S. Cl.
CPC ..... *A63B 37/0039* (2013.01); *A63B 45/00* (2013.01); *A63B 47/008* (2013.01); *A63B 24/0021* (2013.01); *A63B 2220/35* (2013.01); *A63B 2220/36* (2013.01); *A63B 2220/89* (2013.01)

(56) References Cited

U.S. PATENT DOCUMENTS 4,660,039 A * 4/1987 Barricks ..... A63B 24/0021 342/27
4,664,378 A * 5/1987 Van Auken ..... A63B 43/004 139/11
5,082,263 A * 1/1992 Berger ..... A63B 71/0605 340/323 R
5,150,895 A 9/1992 Berger
5,551,688 A * 9/1996 Miller ..... A63B 45/00 473/570
5,662,534 A * 9/1997 Kroll ..... A63B 24/0021 473/353
6,244,971 B1 * 6/2001 Mihran ..... A63B 24/0021 473/200
6,620,057 B1 * 9/2003 Pirritano ..... A63B 24/0021 342/51
2005/0070375 A1 * 3/2005 Savarese ..... A63B 24/0021 473/351
2009/0075744 A1 3/2009 Tuxen
2009/0111619 A1 * 4/2009 Kobayashi ..... A63B 43/00 473/569
2011/0275462 A1 * 11/2011 Saegusa ..... A63B 37/0004 473/570

FOREIGN PATENT DOCUMENTS

JP H05-079573 10/1993
JP H11-076458 3/1999
JP 2001-249177 9/2001
JP 2002-202368 7/2002
JP 2004-166719 6/2004
JP 2007-021204 2/2007
JP 2007-175492 7/2007
JP 2008-538085 10/2008
JP 2009-106612 5/2009
WO WO 2011/074247 6/2011

* cited by examiner

| | HEIGHT OF CONDUCTIVE INTERSECTION SURFACE IN RADIAL DIR ECTION OF SPHERICAL BODY (μm) | SPIN MEASUREMENT VARIATION INDEX |
|---|---|---|
| TEST EXAMPLE 10 | 0 | - |
| TEST EXAMPLE 11 | 20 | 100 |
| TEST EXAMPLE 12 | 150 | 113 |
| TEST EXAMPLE 13 | 300 | 171 |
| TEST EXAMPLE 14 | 500 | 200 |
| TEST EXAMPLE 15 | 900 | 200 |
| TEST EXAMPLE 16 | 1500 | 200 |

BALL FOR BALL GAME

TECHNICAL FIELD

The present technology relates to a ball for a ball game.

BACKGROUND

In recent years, apparatuses using a Doppler radar have been used to measure the trajectory and launching conditions of balls for ball games, and particularly for golf balls (initial velocity, launch angle, and amount of spin of golf balls).

With such apparatuses, a transmission wave comprising microwaves is emitted from an antenna toward a golf ball and a reflection wave that is reflected from the golf ball is measured. Then, based on a Doppler signal obtained from the transmission wave and the reflection wave, the speed of travel and the amount of spin are calculated.

In these cases, the reflection wave must be obtained efficiently in order for the speed of travel and the amount of spin to be measured stably and reliably. In other words, efficiently obtaining the reflection wave is beneficial in the securing of measuring distance.

On the other hand, technology has been suggested for providing a layer or film including a metallic material throughout an entirety of a surface of a ball in order to enhance visual appearance and/or design (see Japanese Unexamined Patent Application Publication Nos. 2007-021204A, 2004-166719A and 2007-175492A).

Additionally, technology has been suggested for providing a metallic layer having a spherical surface shape between a core layer and a cover of a ball in order to ensure energy transfer (see Japanese Unexamined Patent Application Publication No. H11-076458A).

According to the test examples conducted by the present inventors, while beneficial from the perspective of ensuring radio wave reflectivity, when a layer or film including a metallic material is formed in a spherical surface shape throughout an entirety of a surface of a ball, an amount of spin of the ball is insufficient for ensuring measuring distance.

SUMMARY

The present technology provides a ball for a ball game favorable for precisely and accurately measuring launching conditions and measuring trajectory, and a method of manufacturing the same.

A ball for a ball game of the present technology includes a spherical body and intersection surfaces that intersect with a spherical surface centered on the center of the spherical body, and are positioned inward of the outer surface of the spherical body, wherein the intersection surfaces are formed as the conductive intersection surfaces having conductivity.

According to the present technology, a transmission wave emitted from an antenna of a measuring device using a Doppler radar is reflected efficiently by conductive intersection surfaces that move with the rotation of a ball for a ball game. Therefore, signal intensity of a frequency distribution necessary for detecting an amount of spin in the Doppler signal can be ensured and the amount of spin can be detected stably and reliably, which is advantageous from the perspective of precisely and accurately measuring launching conditions and measuring trajectory.

DETAILED DESCRIPTION (First Embodiment)

Prior to describing the embodiments of the ball for a ball game of the present technology, the principles for measuring a speed of travel and an amount of spin of a ball for a ball game using Doppler radar will be described.

Figure 1:
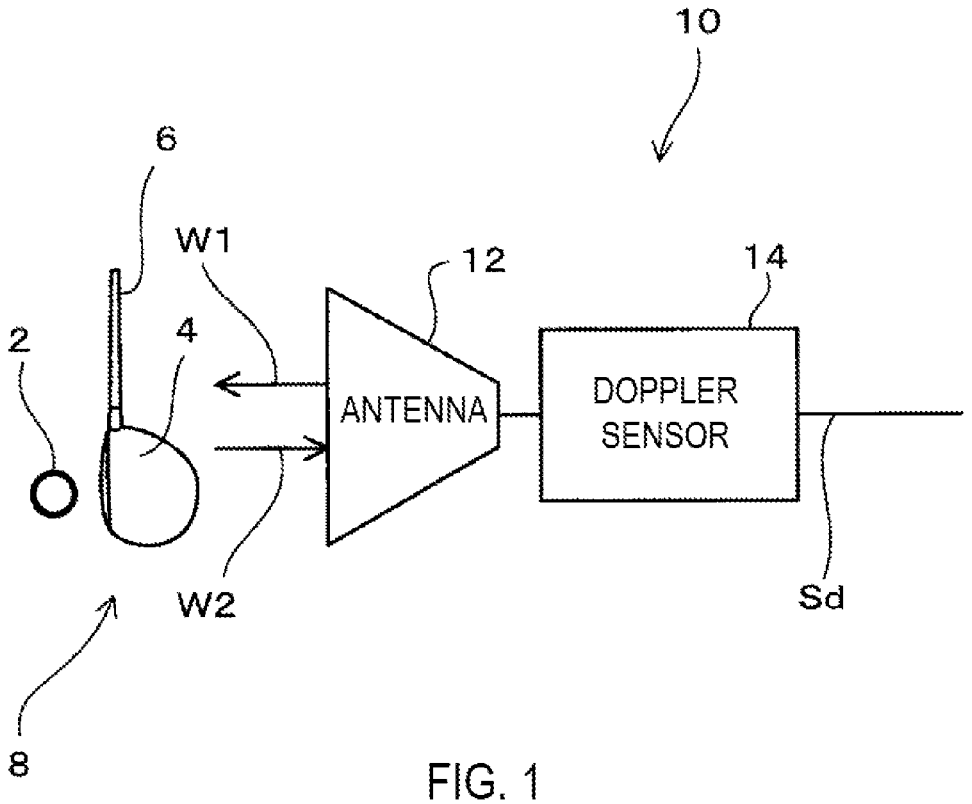
FIG. 1 is a block diagram illustrating the principles for measuring a ball for a ball game using Doppler radar.

As illustrated in FIG. 1, a Doppler radar 10 includes an antenna 12 and a Doppler sensor 14.

Note that, in FIG. 1, the numeral 2 indicates a golf ball as the ball for a ball game, 4 indicates a golf club head, 6 indicates a shaft, and 8 indicates golf club.

Based on a transmission signal supplied from the Doppler sensor 14, the antenna 12 transmits a transmission wave W1(microwaves) toward a golf ball 2, receives a reflection wave W2 reflected by the golf ball 2, and supplies the received signal to the Doppler sensor 14.

The Doppler sensor 14 supplies a transmission signal to the antenna 12. Based on the received signal supplied from the antenna 12, a Doppler signal Sd having a Doppler frequency Fd is generated as time series data.

The "Doppler signal Sd" is a signal having a Doppler frequency Fd defined by a frequency F1-F2, which is a difference between a frequency F1 of the transmission signal and a frequency F2 of the received signal.

Various commercially available sensors can be used as a Doppler sensor 14.

Note that as the transmission signal, a microwave of 24 GHz can, for example, be used and the frequency of the transmission signal is not limited if able to obtain the Doppler signal Sd.

Next, the principles for measuring the velocity and the amount of spin of the golf ball 2 will be described.

As known conventionally, the Doppler frequency Fd is expressed by Formula (1).

$$Fd=F1-F2=2\cdot V\cdot F1/c \quad (1)$$

V is the velocity of the golf ball 2, and c is the speed of light ($3\cdot10^8$ m/s)

Thus, when Formula (1) is solved for V, Formula (2) is obtained.

$$V=c\cdot Fd/(2\cdot F1) \quad (2)$$

In other words, a velocity V of the golf ball 2 is proportional to the Doppler frequency Fd.

Thus, the frequency components of the Doppler frequency Fd are detected from the Doppler signal Sd, and the velocity V of the golf ball 2 can be found from the detected Doppler frequency components based on Formula (2).

Figure 2:
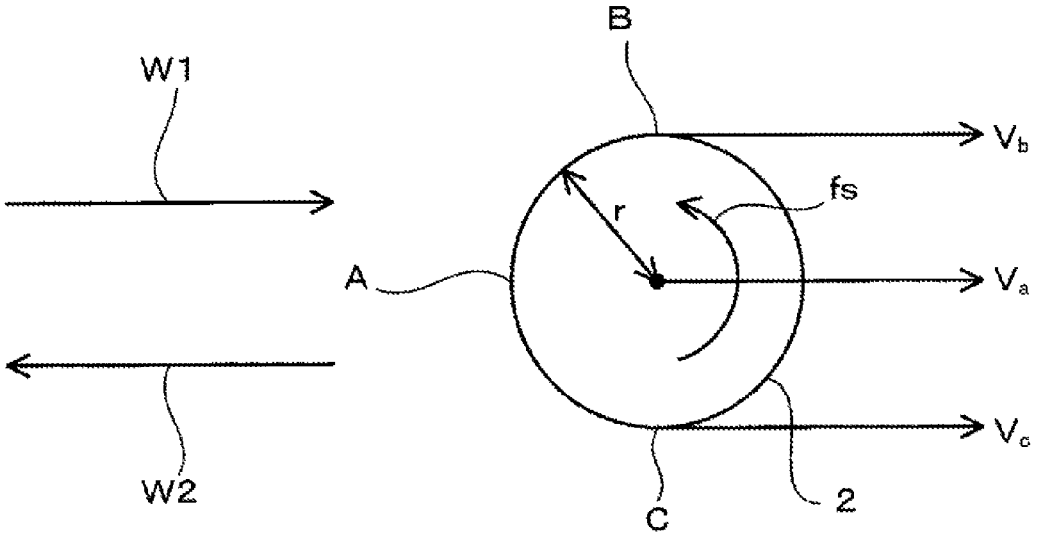
FIG. 2 is an explanatory drawing illustrating the principle for detecting an amount of spin of a golf ball.

FIG. 2 is an explanatory drawing illustrating the principle for detecting an amount of spin of a golf ball.

The transmission wave W1 reflects efficiently at a first portion A of a surface of the golf ball 2, which is a portion of the surface where an angle formed with a transmission direction of the transmission wave W1 is close to 90 degrees. Thus, an intensity of the reflection wave W2 at the first portion A is high.

On the other hand, the transmission wave W1 does not reflect efficiently at a second portion B and a third portion C of a surface of the golf ball, which are portions of the surface where the angle formed with the transmission direction of the transmission wave W1 is close to 0 degrees. Thus, an intensity of the reflection wave W2 at the second portion B and the third portion C is low.

The second portion B is a portion where a direction of rotation of the golf ball 2 and a movement direction of the golf ball 2 are opposite due to spin.

The third portion C is a portion where a direction of rotation of the golf ball 2 and a movement direction of the golf ball 2 are the same due to spin.

When a first portion velocity Va is a velocity detected based on the reflection wave W2 reflected at the first portion A, a second portion velocity Vb is a velocity detected based on the reflection wave W2 reflected at the second portion B, and a third portion velocity Vc is a velocity detected based on the reflection wave W2 reflected at the third portion C, the following formulas are established:

$$Va=V\alpha \quad (3)$$

$$Vb=Va-\omega r \quad (4)$$

$$Vc=Va+\omega r \quad (5)$$

(where Vα is the speed of travel of the golf ball 2, ω is an angular velocity (rad/s), and r is a radius of the golf ball 2)

Thus, in principle, the speed of travel Vα of the golf ball 2 can be obtained from the first portion velocity Va based on Formula (3), and angular velocity ω can be obtained from the second and third portion velocities Vb and Vc based on Formula (4) or Formula (5). From the angular velocity ω, the amount of spin can then be obtained.

However, with a Doppler radar, the speed of travel Vα and the amount of spin are not obtained based on the above-described Formulae. As will be described below, the Doppler radar generates signal intensity distribution data P, which is a distribution of signal intensity at each frequency, through frequency analysis of the Doppler signal Sd. From the signal intensity distribution data P, it is then possible to find the speed of travel Vα and the amount of spin.

Figure 3:
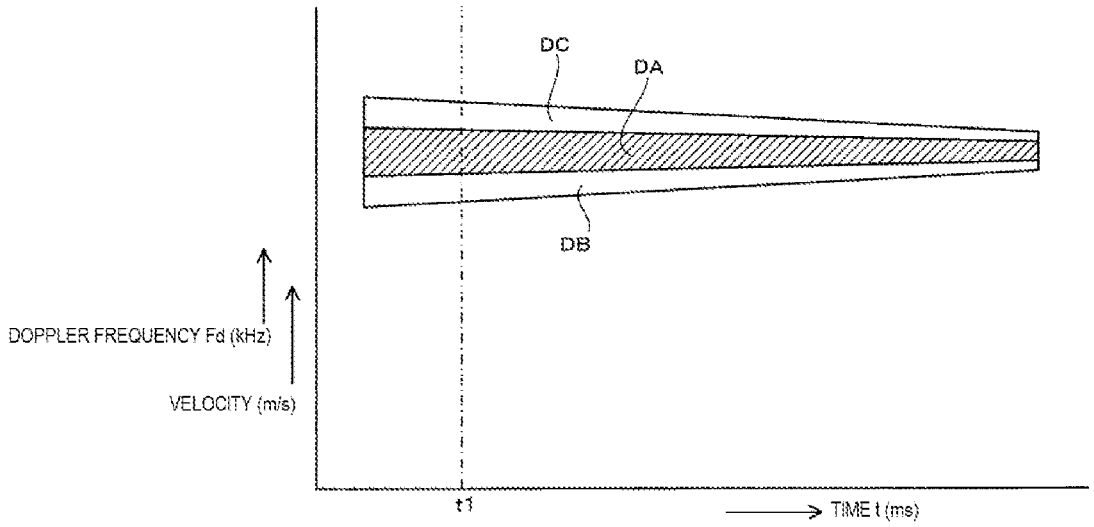
FIG. 3 is an explanatory drawing illustrating the simplified results of a wavelet analysis of a Doppler signal Sd for a case in which the golf ball launched by being struck was measured using a Doppler radar 10.

FIG. 3 is an explanatory drawing illustrating the simplified results of a wavelet analysis of a Doppler signal Sd for a case in which a golf ball launched by being struck was measured using the Doppler radar 10.

Time t (ms) is illustrated on the horizontal axis and the Doppler frequency Fd (kHz) and the velocity V (m/s) of the golf ball 2 are illustrated on the vertical axis.

Such a diagram is obtained by, for example, sampling the Doppler signal Sd, taking in the signal to a digital oscilloscope, converting the signal into digital data, and wavelet analyzing or continuous FFT analyzing the digital data using a personal computer or the like.

In the frequency distribution illustrated in FIG. 3, an intensity of the Doppler signal Sd is high in the portion illustrated using cross-hatching, and the intensity of the Doppler signal Sd in the portion illustrated using solid lines is lower than that of the portion illustrated using the cross-hatching.

Thus, signal intensity of the frequency distribution at the area labeled DA, a portion corresponding to the first portion velocity Va, is high.

Signal intensity of the frequency distribution at the area labeled DB, a portion corresponding to the second portion velocity Vb, is lower than for the frequency distribution DA.

Signal intensity of the frequency distribution at the area labeled DC, a portion corresponding to the third portion velocity Vc, is lower than for the frequency distribution DA.

Figure 4:
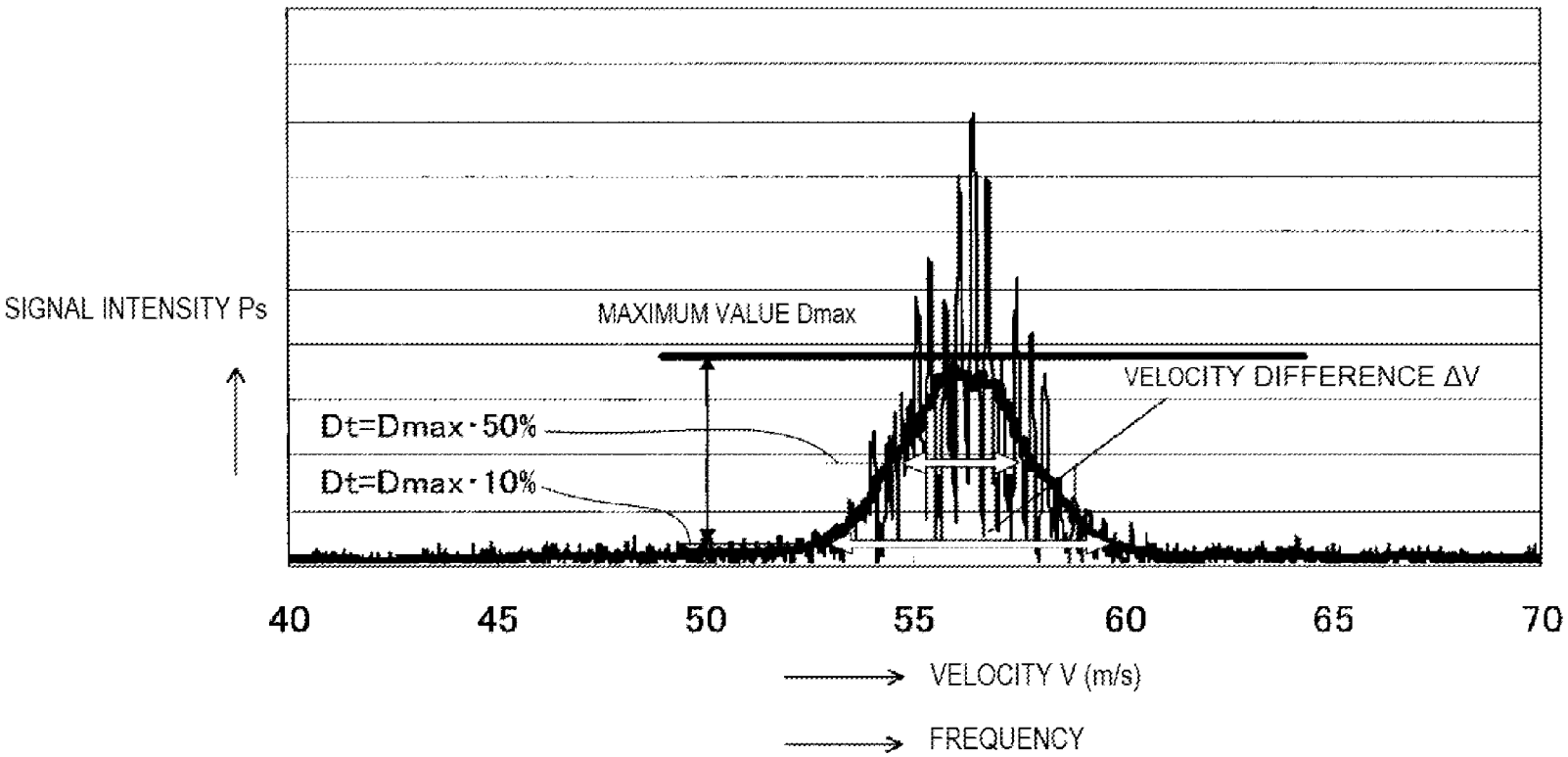
FIG. 4 is an explanatory drawing illustrating signal intensity distribution data P, which is a distribution of the signal intensity at each frequency obtained through frequency analysis of the Doppler signal Sd at time t1 in FIG. 3.

FIG. 4 is an explanatory drawing illustrating signal intensity distribution data P, which is a distribution of the signal intensity at each frequency obtained through frequency analysis of the Doppler signal Sd at time t1 in FIG. 3.

In FIG. 4, velocity V (m/s) is illustrated on the horizontal axis and signal intensity Ps (any unit) is illustrated on the vertical axis. Note that the velocity V on the horizontal axis is proportional to the frequency of the Doppler signal Sd.

The thin line in the plot represents the actually measured values of the signal intensity distribution data P, and the thick line represents a moving average of the actually measured values of the signal intensity distribution data P.

Since the actually measured value of the signal intensity distribution data P fluctuates strongly depending on the affect of spin, the data is stabilized by taking a moving average to obtain signal intensity distribution data P suitable for subsequent signal processing.

The following describes the signal intensity distribution data P represented by the moving average.

As can be seen from FIG. 4, the signal intensity distribution data P has a single maximum value at which the signal intensity Ps is at a maximum and presents a form of single peak in which the signal intensity gradually declines and soon becomes zero as far from the maximum value.

Here, the peak of the signal intensity distribution data P, which is to say, the maximum value Dmax of signal intensity P corresponds to the value of the first portion velocity Va. In other words, the Doppler frequency value corresponding to the maximum value Dmax of signal intensity Ps corresponds to the value of the first portion velocity Va.

Hence, the higher the Doppler frequency corresponding to the maximum value Dmax, the faster the first portion velocity Va, which is to say, the speed of travel of the golf ball 2.

Also, the width of the peak of the signal intensity distribution data P is proportional to a difference ΔV (velocity difference) between the second portion velocity Vb and the third portion velocity Vc.

Hence, the smaller the difference ΔV between the second portion velocity Vb and the third portion velocity Vc, the smaller the amount of spin. Moreover, if the difference ΔV is zero, the amount of spin is also 0. Conversely, the larger the difference ΔV between the second portion velocity Vb and the third portion velocity Vc, the larger the amount of spin.

Here, the difference ΔV between the second portion velocity Vb and the third portion velocity Vc is obtained, as can be seen from Formula (4) and Formula (5), using Formula (6), and is a value proportional to the angular velocity ω.

$$\Delta V = Vc - Vb = (Va + \omega r) - (Va - \omega r) = 2\omega r \quad (6)$$

As is clear from Formula (6), the amount of spin can be obtained based on the width of the peak in the signal intensity distribution data P.

Here, the width of the peak is defined as follows.

The width of the peak of the signal intensity distribution data P is given by a width at a portion of the signal intensity distribution data P where the signal intensity Ps reaches a threshold value Dt, where the threshold value Dt of the signal intensity Ps is Dmax·N (0<N<1).

In FIG. 4, examples are illustrated for which Dt=Dmax·10% and Dt=Dmax·50%. However, the threshold value Dt can be set to any value at which the peak width can be stably obtained.

Thus, as illustrated in FIG. 4, by finding the signal intensity distribution data P of the Doppler signal Sd, the speed of travel Vα and the amount of spin Sp can be easily obtained from the signal intensity distribution data P.

For instance, when a golf ball is actually launched, the peak width of the signal intensity distribution data P and the amount of spin Sp are actually measured together with the maximum value Dmax and the speed of travel Vα.

Then, from these actually measured results, the correlation map between the speed of travel Vα and the maximum value Dmax, and the correlation map between the amount of spin Sp and the peak width of the signal intensity distribution data P are generated.

By using these correlation maps, it is possible to obtain the speed of travel Vα from the maximum value Dmax, and to obtain the amount of spin Sp from the width of the signal intensity distribution data P.

Accordingly, in order to employ these measurement principles to obtain speed of travel Vα, it is important that the maximum value Dmax can be measured reliably.

Similarly, in order to obtain the amount of spin Sp, it is important that the width of the signal intensity distribution data P can be measured reliably.

However, the farther a launched golf ball 2 is from the antenna 12 (the more time has passed), the lower the signal intensity of the reflection wave W2 received by the antenna 12 will be, and the lower the signal intensity of each of the frequency distributions DA, DB, and DC will be.

However, the signal intensities of the frequency distributions DB and DC of the Doppler signal Sd illustrated in FIG. 3 are always weaker than the signal intensity of the frequency distribution DA, which is disadvantageous from the perspective of stably measuring the signal intensities of the frequency distributions DB and DC. Since the signal intensities of the frequency distributions DB and DC receivable by the antenna 12 become unreceivable in a shorter period of time than the signal intensity of the frequency distribution DA, the measurable time of the signal intensities of the frequency distributions DB and DC is extremely limited, and this is disadvantageous.

For reasons such as those described above, it is difficult to reliably measure the width of the peak of the signal intensity distribution data P, and therefore there is a disadvantage from the perspective of obtaining the accurate amount of spin Sp.

Hence, a golf ball 2 is desired for which it is possible for the antenna 12 to reliably and stably receive the signal intensities of frequency distributions DB and DC in the reflection wave W2 that is reflected by the golf ball 2.

Next, the golf ball 2 of this embodiment will be described.

Figure 5:
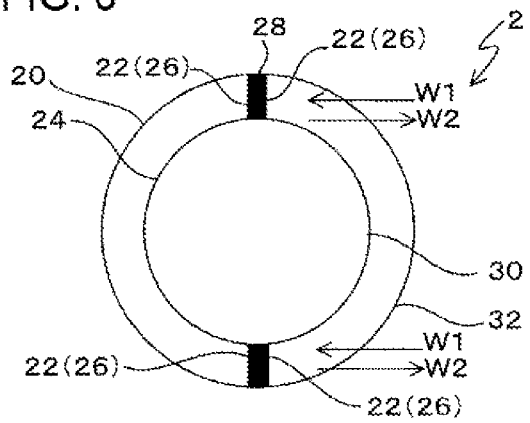
FIG. 5 is a cross-sectional view of a golf ball 2 according to a first embodiment.

FIG. 5 is a cross-sectional view of the golf ball 2 according to the first embodiment.

As illustrated in FIG. 5, the golf ball 2 includes a spherical body 20 and intersection surfaces 22.

The intersection surfaces 22 intersect with a spherical surface 24 centered on the center of the spherical body 20, and are positioned inward of the outer surface of the spherical body 20. The intersection surfaces 22 are formed as conductive intersection surfaces 26 having conductivity.

The spherical surface 24 is formed to have a smaller diameter than the spherical body 20, and the conductive intersection surface 26 is formed on an outer side in the radial direction of the spherical surface 24.

In this embodiment, an annular body 28 (first annular body) formed from an electrically conductive material is protrudingly formed around an entire circumference of the spherical surface 24 that intersects with a plane passing through the center of the spherical surface 24.

For the electrically conductive material, a conductive resin, a conductive elastomer, a conductive fabric, a conductive fiber or other conventionally known material may be used.

In this embodiment, the cross-section profile of the annular body 28 is rectangular.

The conductive intersection surface 26 is formed by both side surfaces of the annular body 28, and so the conductive intersection surface 26 is formed to be continuous around the entire circumferential length of the spherical surface 24 in the circumferential direction.

Since the conductive intersection surface 26 has conductivity, it also has good radio wave reflectivity, meaning that it reflects radio waves (microwaves) efficiently.

It is sufficient that the conductive intersection surface 26 be capable of ensuring a sufficient intensity of the reflection wave W2. For example, by applying a conventional relational expression given below, a necessary range can be calculated as a surface resistance of the conductive intersection surface 26.

Specifically, when Γ is radio wave reflectance and R is surface resistance, the following formulas (10) and (12) are achieved:

$$\Gamma = (377 - R)/(377 + R) \quad (10)$$

$$R = (377(1 - \Gamma))/(1 + \Gamma) \quad (12)$$

$\Gamma=1$ indicates complete reflectance, $\Gamma=0$ indicates zero reflectance, and 377 indicates the characteristic impedance of the air.

Thus, from Formula (12):

when $\Gamma=1$, $R=0$; and when $\Gamma=0$, $R=377$.

Here, when $\Gamma=0.5$, $R=377(0.5/1.5)\approx130$.

Thus, when a value sufficient as the radio wave reflectance $\Gamma$ is set to not less than $\Gamma=0.5$ (50%), the surface resistance R must be not more than 130 Ω/sq.

Additionally, from the perspective of ensuring the intensity of the reflection wave W2, preferably, the radio wave reflectance $\Gamma$ is not less than 0.9 (90%) and the surface resistance R is not more than 20 Ω/sq.

Note that the radio wave reflectance $\Gamma$ can be measured using a conventional method such as a waveguide method, a free space method, or the like.

More specifically, the golf ball 2 includes a spherical and solid core layer 39 and a cover layer 32 that covers the core layer 30.

In this embodiment, the spherical body 20 is formed by the core layer 30 and the cover layer 32, and the spherical surface 24 is the top surface (outer surface) of the core layer 30.

In this embodiment, the core layer 30 is formed from a conventionally known material such as synthetic rubber. The core layer 30 may of course be formed from a single core layer 30 or from two or more core layers 30.

For the cover layer 32, various conventional synthetic resins and the like can be used.

A multiplicity of dimples is formed in a surface of the cover layer 32.

In this embodiment, the leading edge surface of the annular body 28 positioned outward in the radial direction of the spherical body 20 is exposed at the top surface of the cover layer 32.

Next, the effects of the golf ball 2 of this embodiment will be described.

In this embodiment, the intersection surfaces 22 intersect with a spherical surface 24 centered on the center of the spherical body 20 are formed as the conductive intersection surfaces 26 having conductivity.

Thus, the transmission wave W1 emitted from the antenna 12 of the Doppler radar 10 is reflected from the conductive intersection surface 26 that moves as the golf ball 2 rotates. This is advantageous from the perspective of ensuring the radio wave intensity of the reflection wave W2.

Specifically, the transmission wave W1 is efficiently reflected from the conductive intersection surface 26 when the conductive intersection surface 26 is at a position corresponding to the second portion B or the third portion C, which are the areas of the surface where the angle formed with the transmission direction of the transmission wave W1 is close to 0, as illustrated in FIG. 2. Hence, it is possible to ensure the intensity of the reflection wave W2.

Therefore, even if the signal intensity of the reflection wave W2 received by the antenna 12 declines due to the distance between the launched golf ball 2 and the antenna increasing, the signal intensity of each of the frequency distributions DB and DC can be ensured.

In other words, the signal intensity of the frequency distributions DB and DC necessary to detect the amount of spin Sp from the Doppler signal can be ensured, which is advantageous from the perspective of stably and reliably detecting the amount of spin Sp.

Thus, the amount of spin Sp can be stably measured over a longer period of time.

Additionally, in cases where the Doppler radar 10 is applied to an indoor golf simulator, even if the output power of the transmission wave W1 is low and a sufficient S/N ratio cannot be obtained, it is still possible to obtain the frequency distributions DB and DC having sufficient signal intensities.

As a result, with golf simulators, trajectory and carrying distance can be calculated accurately based on the amount of spin Sp as well as the initial velocity and launching angle of the golf ball 2, and simulations that provide a higher degree of accuracy that take into account the amount of spin Sp can be performed.

In other words, taking into account the amount of spin Sp makes it possible to simulate carrying distance with a higher degree of accuracy.

(Second Embodiment)

Next, a second embodiment will be described.

Figure 6:
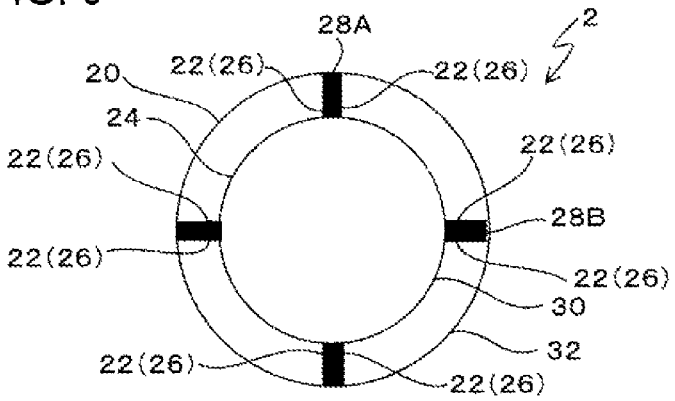
FIG. 6 is a cross-sectional view of a golf ball 2 according to a second embodiment.

FIG. 6 is a cross-sectional view of a golf ball 2 of the second embodiment.

The second embodiment is a modified example of the first embodiment, differing from the first embodiment in that two annular bodies are provided, but is otherwise identical to the first embodiment. In this embodiment, elements identical to those of the first embodiment are assigned identical reference numerals, and detailed descriptions thereof are omitted.

As illustrated in FIG. 6, the golf ball 2 includes a spherical body 20 and intersection surfaces 22.

A first annular body 28A formed from a conductive material is protrudingly formed around an entire circumference of the spherical surface 24 that intersects with a first plane passing through the center of the spherical surface 24.

A second annular body 28B formed from a conductive material is protrudingly formed around an entire circumference of the spherical surface 24 that intersects with a second plane passing through the center of the spherical surface 24, the second plane being orthogonal to the first plane.

The conductive intersection surface 26 is formed by both side surfaces of the first annular body 28A and the second annular body 28B.

Thus, as in the first embodiment, the conductive intersection surfaces 26 are formed to be continuous around the entire circumferential length of the spherical surface 24 in the circumferential direction.

In this embodiment, the cross-sectional profiles of the first annular body 28A and the second annular body 28B are rectangular, and the leading edge surfaces of the first annular body 28A and second annular body 28B positioned outward in the radial direction of the spherical body 20 are exposed at the top surface of the cover layer 32.

The second embodiment described above provides the same effects as provided by the first embodiment.

In addition, in the second embodiment, the number of conductive intersection surfaces 26 is higher than in the first embodiment and so the frequency with which the reflection wave W2 is generated can be increased over that of the first embodiment. Thus, the reflection wave W2 can be received more stably, which is more advantageous from the perspective of stably and reliably detecting the amount of spin Sp, and further advantageous from the perspective of stably measuring the amount of spin Sp over a long period.

(Third Embodiment)

Next, a third embodiment will be described.

Figure 7:
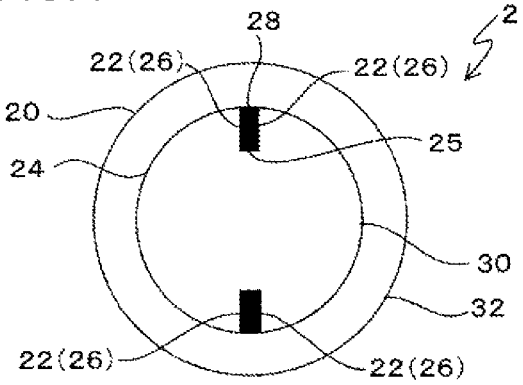
FIG. 7 is a cross-sectional view of a golf ball 2 according to a third embodiment.

FIG. 7 is a cross-sectional view of a golf ball 2 of the third embodiment.

The third embodiment differs from the first embodiment in the positions at which the conductive intersection surfaces 26 are provided.

As illustrated in FIG. 7, the golf ball 2 includes a spherical body 20 and intersection surfaces 22.

The intersection surfaces 22 intersect with a spherical surface 24 centered on the center of the spherical body 20, and are formed as conductive intersection surfaces 26 having conductivity.

The spherical surface 24 is formed to have a smaller diameter than the spherical body 20, and the conductive intersection surfaces 26 are formed on an inner side in the radial direction of the spherical surface 24.

A groove 25 (first groove) is formed around the entire circumference of the spherical surface 24 that intersects with a plane passing through the center of the spherical surface 24.

The annular body 28 (first annular body) is formed by embedding the conductive material in the groove 25.

The conductive intersection surface 26 is formed by both side surfaces of the annular body 28, and the conductive intersection surfaces 26 are therefore formed to be continuous over the entire circumference of the spherical surface 24 in the circumferential direction.

In this embodiment, the cross-section profile of the annular body 28 is rectangular.

More specifically, the golf ball 2 includes a spherical and solid core layer 30 and a cover layer 32 that covers the core layer 30. The spherical body 20 is formed by the core layer 30 and the spherical surface 24 is the top surface (outer surface) of the core layer 30.

The leading edge surface of the annular body 28 positioned outward position in the radial direction of the spherical body 20 is exposed at the top surface of the core layer 30.

The third embodiment described above provides the same effects as provided by the first embodiment.

(Fourth Embodiment)

Next, a fourth embodiment will be described.

Figure 8:
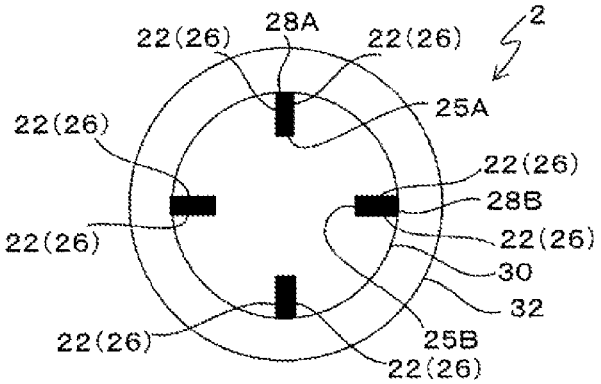
FIG. 8 is a cross-sectional view of a golf ball 2 according to a fourth embodiment.

FIG. 8 is a cross-sectional view of a golf ball 2 of the second embodiment.

The fourth embodiment is a modified example of the third embodiment, differing from the third embodiment in that two annular bodies are provided, but otherwise identical to the third embodiment.

As illustrated in FIG. 8, the golf ball 2 includes a spherical body 20 and intersection surfaces 22.

A first groove 25A is formed around an entire circumference of the spherical surface 24 that intersects with a first plane passing through the center of the spherical surface 24.

A first annular body 28A is formed by embedding a conductive material in the first groove 25A.

A second groove 25B is formed around an entire circumference of the spherical surface 24 that intersects with a second plane passing through the center of the spherical surface 24, the second plane being orthogonal to the first plane.

A second annular body 28B is formed by embedding the conductive material in the second groove 25B.

The conductive intersection surface 26 is formed by both side surfaces of the first annular body 28A and the second annular body 28B.

Thus, as in the second embodiment, the conductive intersection surfaces 26 are formed to be continuous around the entire circumferential length of the spherical surface 24 in the circumferential direction.

In this embodiment, the cross-sectional profiles of the first annular body 28A and the second annular body 28B are rectangular, and the leading edge surfaces of the first annular body 28A and second annular body 28B positioned outward in the radial direction of the spherical body 20 are exposed at the top surface of the core layer 30.

The fourth embodiment described above provides the same effects as provided by the third embodiment.

In addition, in the fourth embodiment, the number of conductive intersection surfaces 26 is higher than in the third embodiment and so the frequency with which the reflection wave W2 is generated can be increased over that of the third embodiment. Thus, the reflection wave W2 can be received more stably, which is more advantageous from the perspective of stably and reliably detecting the amount of spin Sp, and further advantageous from the perspective of measuring the amount of spin Sp stably over a long period.

(Fifth Embodiment)

Next, a fifth embodiment will be described.

Figure 9:
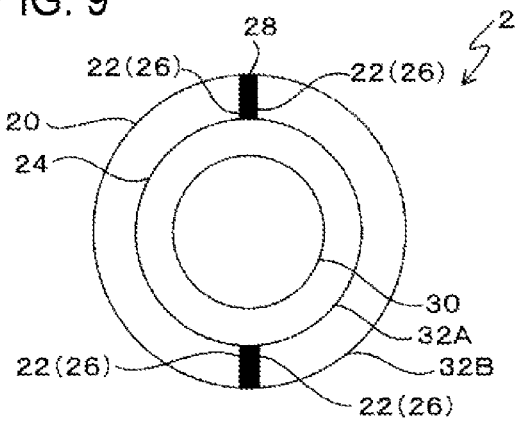
FIG. 9 is a cross-sectional view of a golf ball 2 according to a fifth embodiment.

FIG. 9 is a cross-sectional view of a golf ball 2 of the fifth embodiment.

The fifth embodiment differs from the first embodiment in the positions at which the conductive intersection surfaces 26 are provided.

As illustrated in FIG. 9, the golf ball 2 includes a spherical body 20 and intersection surfaces 22.

The intersection surfaces 22 intersect with a spherical surface 24 centered on the center of the spherical body 20, and are formed as conductive intersection surfaces 26 having conductivity.

The spherical surface 24 is formed to have a smaller diameter than the spherical body 20, and the conductive intersection surface 26 is formed on an outer side in the radial direction of the spherical surface 24.

An annular body 28 formed from a conductive material is protrudingly formed around an entire circumference of the spherical surface 24 that intersects with a plane passing through the center of the spherical surface 24.

The conductive intersection surface 26 is formed by both side surfaces of the annular body 28, and so the conductive intersection surface 26 is formed to be continuous around the entire circumferential length of the spherical surface 24 in the circumferential direction.

In this embodiment, the cross-sectional profile of the annular body 28 is rectangular.

More specifically, the spherical body 20 is formed by a spherical and solid core layer 30, and a first cover layer 32A and a second cover layer 32B that cover the core layer 30.

In this embodiment, the first cover layer 32A and the second cover layer 32B constitute multiple layers covering the core layer 30.

The first cover layer 32A and second cover layer 32B are formed form material that allows passage of radio waves so that the radio waves will be reflected from the conductive intersection surfaces 26.

A multiplicity of dimples is formed in a top surface of the second cover layer 32B.

The spherical surface 24 is formed by the top surface of the first cover layer 32A.

In this embodiment, the leading edge surfaces of the first annular body 28A positioned outward in the radial direction of the spherical body 20 are exposed at the top surface of the second cover layer 32B.

The fifth embodiment described above provides the same effects as provided by the first embodiment.

(Sixth Embodiment)

Next, a sixth embodiment will be described.

Figure 10:
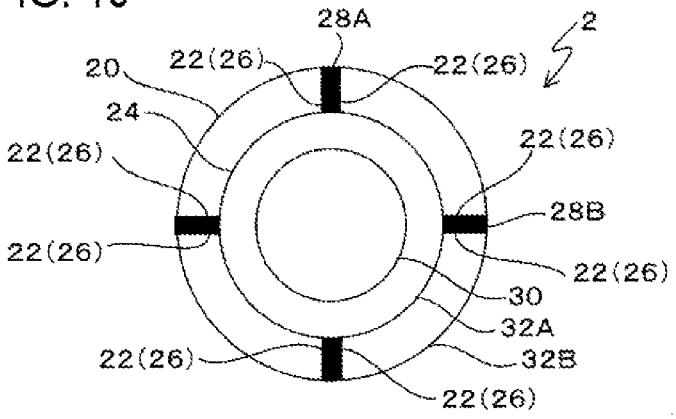
FIG. 10 is a cross-sectional view of a golf ball 2 according to a sixth embodiment.

FIG. 10 is a cross-sectional view of a golf ball 2 of the sixth embodiment.

The sixth embodiment is a modified example of the fifth embodiment, differing from the fifth embodiment in that two annular bodies are provided, but otherwise identical to the fifth embodiment.

As illustrated in FIG. 10, the golf ball 2 includes a spherical body 20 and intersection surfaces 22.

A first annular body 28A formed from a conductive material is protrudingly formed around an entire circumference of the spherical surface 24 that intersects with a first plane passing through the center of the spherical surface 24 in the circumferential direction.

A second annular body 28B formed from a conductive material is protrudingly formed around an entire circumference of the spherical surface 24 that intersects with a second plane passing through the center of the spherical surface 24, the second plane being orthogonal to the first plane.

The conductive intersection surface 26 is formed by both side surfaces of the first annular body 28A and the second annular body 28B.

Thus, the conductive intersection surfaces 26 are formed to be continuous over the entire circumference of the spherical surface 24 in the circumferential direction.

In this embodiment, the cross-sectional profiles of the first annular body 28A and the second annular body 28B are rectangular.

More specifically, the spherical body 20 is formed by a spherical and solid core layer, and a first cover layer 32A and a second cover layer 32B that cover the core layer 30.

The first cover layer 32A and the second cover layer 32B are formed form material that allows passage of radio waves so that the radio waves will be reflected from the conductive intersection surfaces 26.

The spherical surface 24 is formed by the top surface of the first cover layer 32A.

In this embodiment, the leading edge surfaces of the first annular body 28A and second annular body 28B positioned outward in the radial direction of the spherical body 20 are exposed at the top surface of the second cover layer 32B.

The sixth embodiment described above provides the same effects as provided by the first embodiment.

In addition, in the sixth embodiment, the number of conductive intersection surfaces 26 is higher than in the fifth embodiment and so the frequency with which the reflection wave W2 is generated can be increased over that of the first embodiment. Thus, the reflection wave W2 can be received more stably, which is more advantageous from the perspective of stably and reliably detecting the amount of spin Sp, and further advantageous from the perspective of measuring the amount of spin Sp stably over a long period.

(Seventh Embodiment)

Next, a seventh embodiment will be described.

Figure 11:
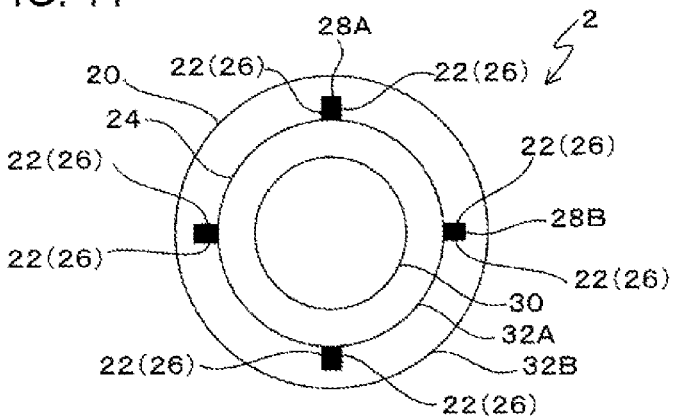
FIG. 11 is a cross-sectional view of a golf ball 2 according to a seventh embodiment.

FIG. 11 is a cross-sectional view of a golf ball 2 of the seventh embodiment.

The seventh embodiment is a modified example of the sixth embodiment, differing from the first embodiment in that the first annular body 28A and the second annular body 28B are covered by the second cover layer 32B, but otherwise identical to the sixth embodiment.

Specifically, in this embodiment, the cross-sectional profiles of the first annular body 28A and the second annular body 28B are rectangular, and the leading edge surfaces of the first annular body 28A and second annular body 28B positioned outward in the radial direction of the spherical body 20 are covered by the second cover layer 32B.

The seventh embodiment described above provides the same effects as provided by the sixth embodiment.

(Eighth Embodiment)

Next, an eighth embodiment will be described.

Figure 12:
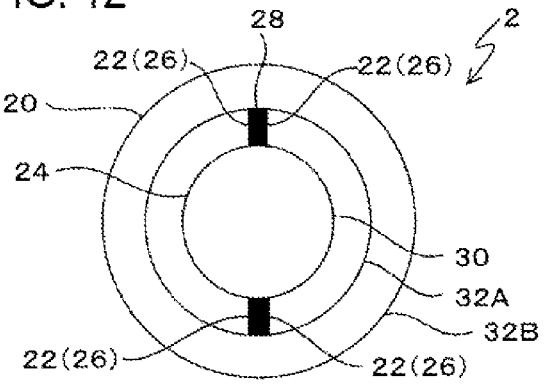
FIG. 12 is a cross-sectional view of a golf ball 2 according to an eighth embodiment.

FIG. 12 is a cross-sectional view of a golf ball 2 of the eighth embodiment.

The eighth embodiment is a modified example of the fifth embodiment, differing from the fifth embodiment in the positions at which the conductive intersection surfaces 26 are provided.

As illustrated in FIG. 12, the golf ball 2 includes a spherical body 20 and intersection surfaces 22.

The intersection surfaces 22 intersect with a spherical surface 24 centered on the center of the spherical body 20, and are formed as conductive intersection surfaces 26 having conductivity.

The spherical surface 24 is formed to have a smaller diameter than the spherical body 20, and the conductive intersection surface 26 is formed on an outer side in the radial direction of the spherical surface 24.

An annular body 28 formed from a conductive material is protrudingly formed around an entire circumference of the spherical surface 24 that intersects with a plane passing through the center of the spherical surface 24.

The conductive intersection surface 26 is formed by both side surfaces of the annular body 28, and so the conductive intersection surface 26 is formed to be continuous around the entire circumferential length of the spherical surface 24 in the circumferential direction.

In this embodiment, the cross-section profile of the annular body 28 is rectangular.

More specifically, the spherical body 20 is formed by a spherical and solid core layer 30, and a first cover layer 32A and a second cover layer 32B that cover the core layer 30.

The spherical surface 24 is formed by the top surface of the core layer 30.

In this embodiment, the leading edge surfaces of the first annular body 28 positioned outward in the radial direction of the spherical body 20 are exposed at the top surface of the first cover layer 32A and covered by the second cover layer 32B.

The eighth embodiment described above provides the same effects as provided by the first embodiment.

(Ninth Embodiment)

Next, a ninth embodiment will be described.

Figure 13:
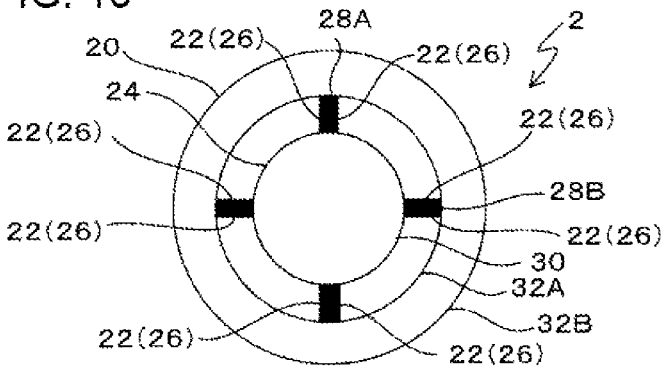
FIG. 13 is a cross-sectional view of a golf ball 2 according to a ninth embodiment.

FIG. 13 is a cross-sectional view of a golf ball 2 of the ninth embodiment.

The ninth embodiment is a modified example of the eighth embodiment, differing from the eighth embodiment in that two annular bodies are provided, but otherwise identical to the eighth embodiment.

As illustrated in FIG. 13, the golf ball 2 includes a spherical body 20 and intersection surfaces 22.

A first annular body 28A formed from a conductive material is protrudingly formed around an entire circumference of the spherical surface 24 that intersects with a first plane passing through the center of the spherical surface 24.

A second annular body 28B formed from a conductive material is protrudingly formed around an entire circumference of the spherical surface 24 that intersects with a second plane passing through the center of the spherical surface 24, the second plane being orthogonal to the first plane.

The conductive intersection surface 26 is formed by both side surfaces of the first annular body 28A and the second annular body 28B.

Thus, the conductive intersection surfaces 26 are formed to be continuous over the entire circumference of the spherical surface 24 in the circumferential direction.

In this embodiment, the cross-sectional profiles of the first annular body 28A and the second annular body 28B are rectangular, and the leading edge surfaces of the first annular body 28A and second annular body 28B positioned outward in the radial direction of the spherical body 20 are exposed at the top surface of the first cover layer 32A and covered by the second cover layer 32B.

More specifically, the spherical body 20 is formed by a spherical and solid core layer 30, and the first cover layer 32A and the second cover layer 32B that cover the core layer 30, and the spherical surface 24 is formed by the top surface of the core layer 30.

The ninth embodiment described above provides the same effects as provided by the first embodiment.

In addition, in the ninth embodiment, the number of conductive intersection surfaces 26 is higher than in the eighth embodiment and so the frequency with which the reflection wave W2 is generated can be increased over that of the eighth embodiment. Thus, the reflection wave W2 can be received more stably, which is more advantageous from the perspective of stably and reliably detecting the amount of spin Sp, and further advantageous from the perspective of measuring the amount of spin Sp stably over a long period.

(Tenth Embodiment)

Next, a tenth embodiment will be described.

Figure 14:
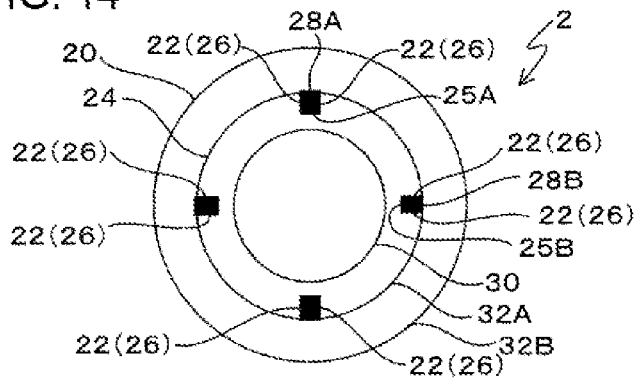
FIG. 14 is a cross-sectional view of a golf ball 2 according to a tenth embodiment.

FIG. 14 is a cross-sectional view of a golf ball 2 of the tenth embodiment.

The tenth embodiment is a modified example of the ninth embodiment, differing from the ninth embodiment in the positions at which the conductive intersection surfaces 26 are provided.

As illustrated in FIG. 14, the golf ball 2 includes a spherical body 20 and intersection surfaces 22.

A first groove 25A is formed around an entire circumference of the spherical surface 24 at the intersection with a first plane passing through the center of the spherical surface 24.

A first annular body 28A is formed by embedding a conductive material in the first groove 25A.

A second groove 25B is formed around an entire circumference of the spherical surface 24 that intersects with a second plane passing through the center of the spherical surface 24, the second plane being orthogonal to the first plane.

A second annular body 28B is formed by embedding a conductive material in the second groove 25B.

The conductive intersection surface 26 is formed by both side surfaces of the first annular body 28A and the second annular body 28B.

Thus, the conductive intersection surfaces 26 are formed to be continuous over the entire circumference of the spherical surface 24 in the circumferential direction.

In this embodiment, the cross-sectional profiles of the first annular body 28A and the second annular body 28B are rectangular.

More specifically, the spherical body 20 is formed by a spherical and solid core layer 30 and a first cover layer 32A and a second cover layer 32B that cover the core layer 30, and the spherical surface 24 is formed by the top surface of the first cover layer 32A.

In this embodiment, the leading edge surfaces of the first annular body 28A and second annular body 28B positioned outward in the radial direction of the spherical body 20 are exposed at the top surface of the first cover layer 32A and covered by the second cover layer 32B.

The tenth embodiment described above provides the same effects as provided by the first embodiment.

(Eleventh Embodiment)

Next, an eleventh embodiment will be described.

Figure 15:
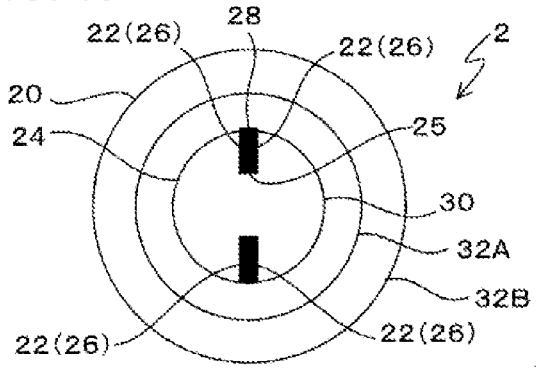
FIG. 15 is a cross-sectional view of a golf ball 2 according to a second embodiment.

FIG. 15 is a cross-sectional view of a golf ball 2 of the eleventh embodiment.

The eleventh embodiment differs from the first embodiment in the positions at which the conductive intersection surfaces 26 are provided.

As illustrated in FIG. 15, the golf ball 2 includes a spherical body 20 and intersection surfaces 22.

A groove 25 is formed around an entire circumference of the spherical surface 24 that intersects with a plane passing through the center of the spherical surface 24.

The annular body 28 (first annular body) is formed by embedding the conductive material in the groove 25.

The conductive intersection surface 26 is formed by both side surfaces of the annular body 28.

Thus, the conductive intersection surfaces 26 are formed to be continuous over the entire circumference of the spherical surface 24 in the circumferential direction.

In this embodiment, the cross-sectional profile of the annular body 28 is rectangular.

More specifically, the spherical body 20 is formed by a spherical and solid core layer 30, and a first cover layer 32A and a second cover layer 32B that cover the core layer 30, and the spherical surface 24 is formed by the top surface of the core layer 30.

The first cover layer 32A and the second cover layer 32B are formed from material that allows passage of radio waves so that the radio waves will be reflected from the conductive intersection surfaces 26.

In this embodiment, the leading edge surfaces of the first annular body 28 positioned outward in the radial direction of the spherical body 20 are exposed at the top surface of the first core layer 30 and covered by the first cover layer 32A.

The eleventh embodiment described above provides the same effects as provided by the first embodiment.

(Twelfth Embodiment)

Next, a twelfth embodiment will be described.

Figure 16:
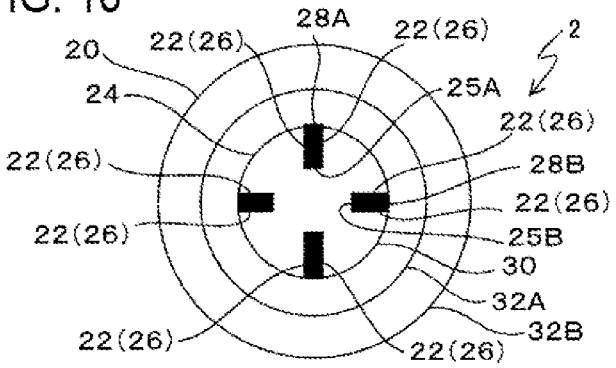
FIG. 16 is a cross-sectional view of a golf ball 2 according to a twelfth embodiment.

FIG. 16 is a cross-sectional view of a golf ball 2 of the twelfth embodiment.

The twelfth embodiment is a modified example of the eleventh embodiment, differing from the tenth embodiment in that two annular bodies are provided, but otherwise identical to the tenth embodiment.

As illustrated in FIG. 16, the golf ball 2 includes a spherical body 20 and intersection surfaces 22.

A first groove 25A is formed around an entire circumference of the spherical surface 24 that intersects with a first plane passing through the center of the spherical surface 24.

A first annular body 28A is formed by embedding a conductive material in the first groove 25A.

A second groove 25B is formed around an entire circumference of the spherical surface 24 that intersects with a second plane passing through the center of the spherical surface 24, the second plane being orthogonal to the first plane.

A second annular body 28B is formed by embedding the conductive material in the second groove 25B.

The conductive intersection surface 26 is formed by both side surfaces of the first annular body 28A and the second annular body 28B.

Thus, the conductive intersection surfaces 26 are formed to be continuous over the entire circumference of the spherical surface 24.

In this embodiment, the cross-sectional profile of the annular body 28 is rectangular.

More specifically, the spherical body 20 is formed by a spherical and solid core layer 30, and a first cover layer 32A and a second cover layer 32B that cover the core layer 30, and the spherical surface 24 is formed by the top surface of the core layer 30.

In this embodiment, the leading edge surfaces of the first annular body 28A and second annular body 28B positioned outward in the radial direction of the spherical body 20 are exposed at the top surface of the core layer 30 and covered by the first cover layer 32A.

The twelfth embodiment described above provides the same effects as provided by the first embodiment.

In addition, in the twelfth embodiment, the number of conductive intersection surfaces 26 is higher than in the eleventh embodiment and so the frequency with which the reflection wave W2 is generated can be increased over that of the eleventh embodiment. Thus, the reflection wave W2 can be received more stably, which is more advantageous from the perspective of stably and reliably detecting the amount of spin Sp, and further advantageous from the perspective of stably measuring the amount of spin Sp over a long period.

(Thirteenth Embodiment)

Next, a thirteenth embodiment will be described.

Figure 17:
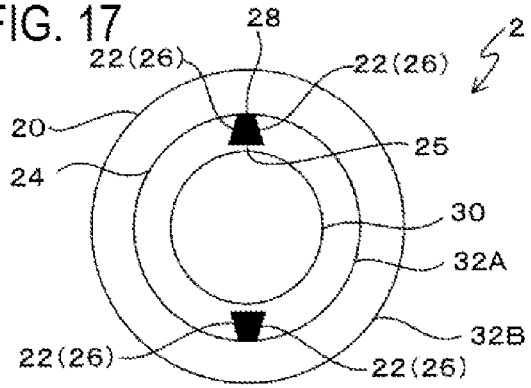
FIG. 17 is a cross-sectional view of a golf ball 2 according to a thirteenth embodiment.

FIG. 17 is a cross-sectional view of a golf ball 2 of the thirteenth embodiment.

The thirteenth embodiment is a modified example of the eighth embodiment illustrated in FIG. 12, differing from the eighth embodiment in cross-sectional profile of the annular body 28, but otherwise identical to the eighth embodiment.

As illustrated in FIG. 17, the golf ball 2 includes a spherical body 20 and intersection surfaces 22.

A groove 25 is formed around an entire circumference of the spherical surface 24 that intersects with a plane passing through the center of the spherical surface 24.

The annular body 28 (first annular body) is formed by embedding the conductive material in the groove 25.

The conductive intersection surface 26 is formed by both side surfaces of the annular body 28.

Thus, the conductive intersection surfaces 26 are formed to be continuous over the entire circumference of the spherical surface 24 in the circumferential direction.

In this embodiment, the cross-sectional profile of the annular body 28 is a trapezoidal shape in which the width decreases toward the outer side in the radial direction of the spherical body 20.

More specifically, the spherical body 20 is formed by a spherical and solid core layer 30 and a first cover layer 32A and a second cover layer 32B that cover the core layer 30, and the spherical surface 24 is formed by the top surface of the first cover layer 32A.

In this embodiment, the leading edge surfaces of the first annular body 28 positioned outward in the radial direction of the spherical body 20 are exposed at the top surface of the first cover layer 32A and covered by the second cover layer 32B.

The thirteenth embodiment described above provides the same effects as provided by the first embodiment.

(Fourteenth Embodiment)

Next, a fourteenth embodiment will be described.

Figure 18:
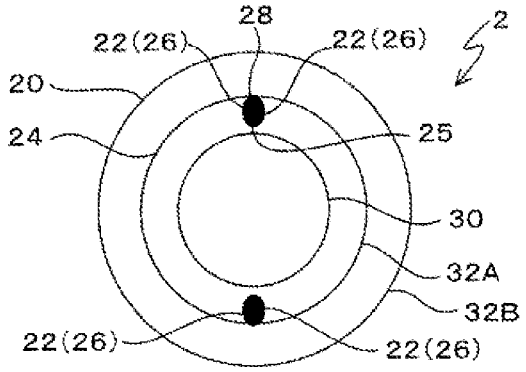
FIG. 18 is a cross-sectional view of a golf ball 2 according to a fourteenth embodiment.

FIG. 18 is a cross-sectional view of a golf ball 2 of the fourteenth embodiment.

The fourteenth embodiment is a modified example of the thirteenth embodiment, differing from the thirteenth embodiment in the cross-sectional profile of the annular body 28, but otherwise identical to the thirteenth embodiment.

As illustrated in FIG. 18, the golf ball 2 includes a spherical body 20 and intersection surfaces 22.

A groove 25 is formed around an entire circumference of the spherical surface 24 that intersects with a plane passing through the center of the spherical surface 24.

The annular body 28 is formed by embedding the conductive material in the groove 25.

The conductive intersection surface 26 is formed by both side surfaces of the annular body 28.

Thus, the conductive intersection surfaces 26 are formed to be continuous over the entire circumference of the spherical surface 24 in the circumferential direction.

In this embodiment, the cross-sectional profile of the annular body 28 is elliptical, with the long axis of the ellipse aligned with the radial direction of the spherical body 20.

More specifically, the spherical body 20 is formed by a spherical and solid core layer 30 and a first cover layer 32A and a second cover layer 32B that cover the core layer 30, and the spherical surface 24 is formed by the top surface of the first cover layer 32A.

In this embodiment, the leading edge surfaces of the first annular body 28 positioned outward in the radial direction of the spherical body 20 are exposed at the top surface of the first cover layer 32A and covered by the second cover layer 32B.

The fourteenth embodiment described above provides the same effects as provided by the first embodiment.

(Fifteenth Embodiment)

Next, a fifteenth embodiment will be described.

Figure 19:
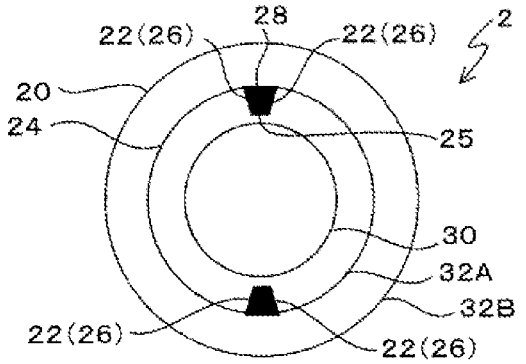
FIG. 19 is a cross-sectional view of a golf ball 2 according to a fifteenth embodiment.

FIG. 19 is a cross-sectional view of a golf ball 2 of the fifteenth embodiment.

The fifteenth embodiment is a modified example of the thirteenth embodiment, differing from the thirteenth embodiment in the cross-sectional profile of the annular body 28, but otherwise identical to the thirteenth embodiment.

As illustrated in FIG. 19, the golf ball 2 includes a spherical body 20 and intersection surfaces 22.

A groove 25 is formed around an entire circumference of the spherical surface 24 that intersects with a plane passing through the center of the spherical surface 24.

The annular body 28 is formed by embedding the conductive material in the groove 25.

The conductive intersection surface 26 is formed by both side surfaces of the annular body 28.

Thus, the conductive intersection surfaces 26 are formed to be continuous over the entire circumference of the spherical surface 24 in the circumferential direction.

In this embodiment, the cross-sectional profile of the annular body 28 is a trapezoidal shape in which the width increases toward the outer side in the radial direction of the spherical body 20. The conductive intersection surfaces 26 are formed so as to be positioned on planes that pass through the center of the spherical body 20.

More specifically, the spherical body 20 is formed by a spherical and solid core layer 30 and a first cover layer 32A and a second cover layer 32B that cover the core layer 30, and the spherical surface 24 is formed by the top surface of the first cover layer 32A.

In this embodiment, the leading edge surfaces of the first annular body 28 positioned outward in the radial direction of the spherical body 20 are exposed at the top surface of the first cover layer 32A and covered by the second cover layer 32B.

The fifteenth embodiment described above provides the same effects as provided by the first embodiment.

Further, the conductive intersection surfaces 26 are formed so as to be positioned on planes that pass through the center of the spherical body 20. Hence, as illustrated in FIG.

2, by arranging the conductive intersection surfaces 26 to be orthogonal to the transmission direction of the transmission wave W1, the highest rotation speed of the conductive intersection surfaces 26 and consequently the most efficiently reflected reflection wave W2 can be obtained.

Thus, the difference in velocity between the second portion velocity Vb and the third portion velocity Vc illustrated in FIG. 2 increases and it becomes possible to obtain a wider range of frequency components of the reflection wave W2 and, in turn, to stably obtain the signal intensity distribution data P of FIG. 4 which is advantageous from perspective of performing more accurate calculation of the amount of spin.

(Working Example 1)

Next, the results of test examples on the golf ball 2 will be described. Note that the test examples described below were performed on the golf ball 2 of the first embodiment.

The following describes a working example.

Test example conditions are as follows:

In Test Example 1, no conductive intersection surfaces 26 were formed in the golf ball 2.

In Test Example 2, the conductive intersection surfaces 26 were formed in the golf ball 2. The height of the conductive intersection surfaces 26 along the radial direction of the spherical body 20 was 0.3 mm.

In Test Example 3, the conductive intersection surfaces 26 were formed in the golf ball 2. The height of the conductive intersection surfaces 26 along the radial direction of the spherical body 20 was 0.5 mm.

The golf balls 2 of the above-described configuration were launched using a golf ball launching device (launcher) and measurements were taken using measuring apparatus that included the Doppler radar 10. Frequency analysis was then used on the Doppler signal Sd to obtain signal intensity distribution data P indicating the distribution of signal intensity at each frequency.

The amount of spin imparted to the golf ball 2 by the golf ball launcher was 5,000 rpm.

Figure 21A:
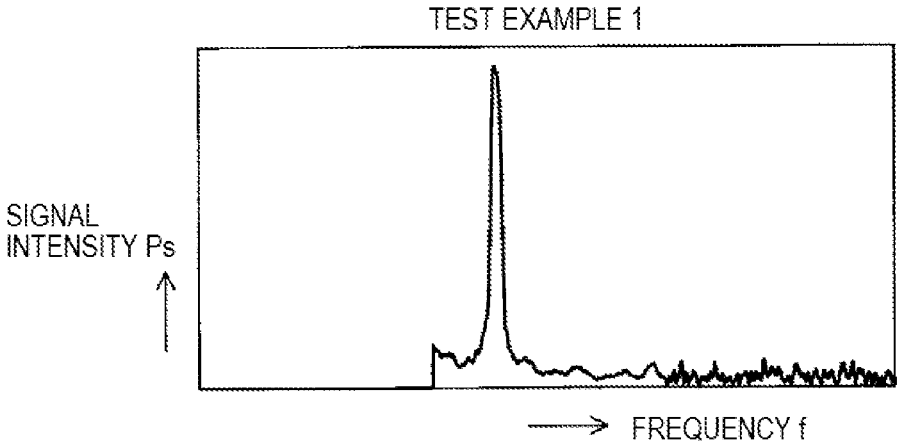
FIG. 21A to 21C are plots illustrating signal intensity distribution data Ps for Test Examples 1 to 3 on Working Example 1.
Figure 21B:
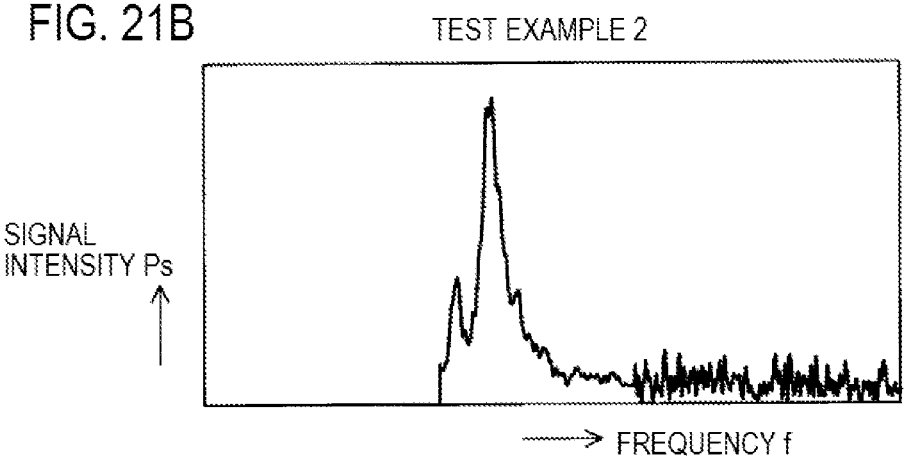
Figure 21C:
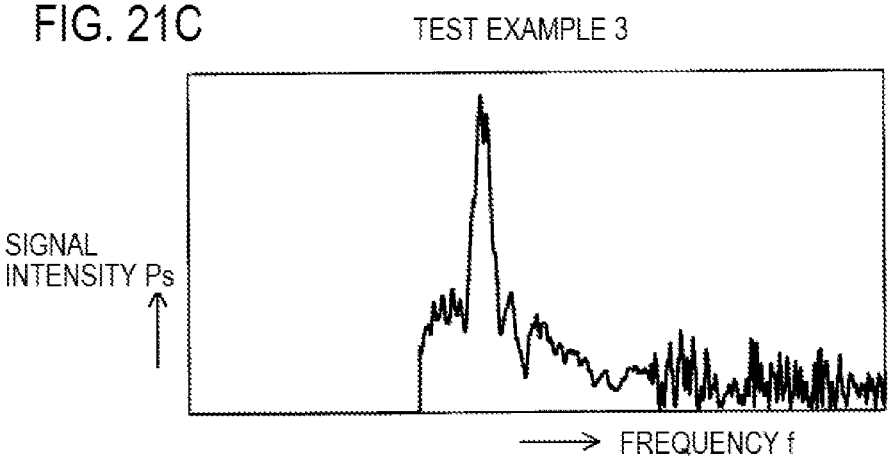

FIGS. 21A to 21C are plots illustrating signal intensity distribution data Ps in Test Examples 1 to 3.

In FIGS. 21B and 21C, the width of the peak in the waveform of the signal intensity distribution data Ps was ensured to be wider than that in FIG. 21A.

Further, in FIG. 21C, the width of the peak in the waveform of the signal intensity distribution data Ps was greater than that in FIG. 21B.

Thus, it is clear that forming the conductive intersection surfaces 26 is advantageous in enabling the amount of spin to be measured accurately. It is also clear that the larger the area of the conductive intersection surfaces 26, the greater the benefit in terms of accurately measuring the amount of spin.

Note that although the embodiments described examples in which conductive intersection surfaces 26 were formed around the entire circumference of the spherical surface 24 in the circumferential direction, the conductive intersection surfaces 26 may be formed in plurality at intervals in the circumferential direction of the spherical surface 24.

Moreover, the conductive intersection surfaces 26 are not necessarily formed along the circumferential direction of the spherical surface 24, but may be irregularly formed.

In the embodiments, examples were described in which the annular body 28 formed from the electrically conductive material was provided and the conductive intersection surfaces 26 were formed on both side surfaces of the annular body 28.

However, it is sufficient that the conductive intersection surfaces 26 intersect with the spherical surface 24 centered at the center of the spherical body 20. The present technology is not limited to configurations in which the conductive intersection surfaces 26 are formed using the annular body 28 made of electrically conductive material.

For instance, any of the following configurations may be used.

1) The conductive intersection surfaces 26 may be formed by protrudingly forming an annular body 28 made of a non-electrically conductive material on the spherical surface 24, forming intersection surfaces 22 on both side surfaces of the annular body 28, and then coating the top surface of the intersection surfaces 22 with a material containing a metallic powder.

2) The conductive intersection surfaces 26 may be formed by bonding metal foil, conductive resin, conductive elastomer, conductive fabric or conductive fiber to the top surface of the intersection surfaces 22 described above.

3) The conductive intersection surfaces 26 may be formed by depositing an electrically conductive material on the top surface of the intersection surfaces 22 described above.

Alternatively, the conductive intersection surfaces 26 may be configured as illustrated in FIGS. 20A to 20D. In these examples, the spherical body 20 is formed by the spherical and solid core layer 30 and the first cover layer 32A and the second cover layer 32B that cover the core layer 30, and the spherical surface 24 is formed by the top surface of the first cover layer 32A. Note, however, that the spherical surface 24 might alternatively be positioned at the top surface of the second cover layer 32B or at the top surface of the core layer 30.

Figure 20A:
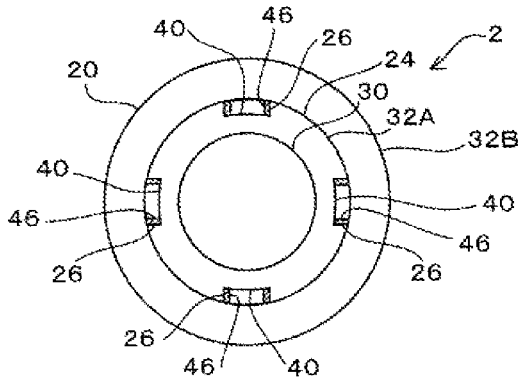
FIGS. 20A to 20D are cross-sectional views of a golf ball 2 illustrating modified examples of a conductive intersection surface 26.

1) As illustrated in FIG. 20A, a configuration may be used in which one or more recesses 40 are provided in the spherical surface 24, electrically conductive material 46 is formed on the side surfaces of the recesses 40, and the electrically conductive material 46 formed on the side surfaces of the recesses 40 is used as the conductive intersection surfaces 26. In this case, any configuration is possible provided that that portions of the recesses 40 not including the conductive intersection surfaces 26 do not block the reflections of the transmission wave W1 from the conductive intersection surfaces 26. For instance, the portions of the recesses 40 not including the conductive intersection surfaces 26 may be filled with a material similar to that of the first cover layer 32A or a material similar to that of the second cover layer 32B.

Figure 20B:
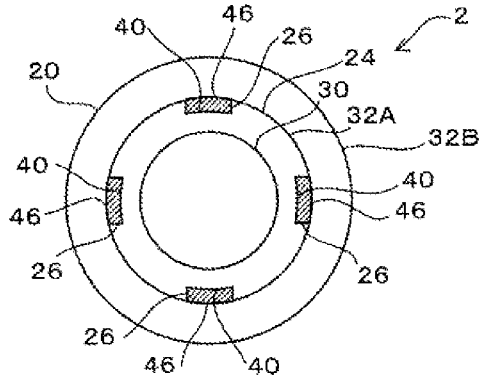

2) As illustrated in FIG. 20B, a configuration may be used in which one or more recesses 40 are provided in the spherical surface 24, the recesses 40 are filled with electrically conductive material 46, and the material 46 filled is used as the conductive intersection surfaces 26.

Figure 20C:
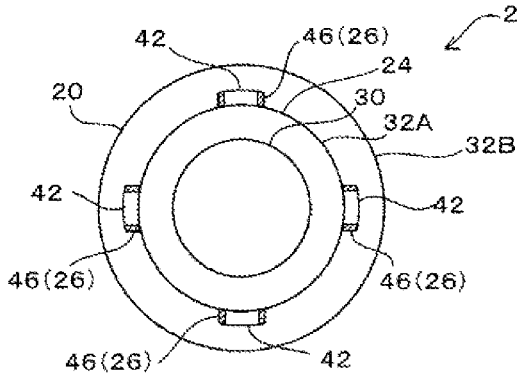

3) As illustrated in FIG. 20C, a configuration may be used in which one or more protrusions 42 are provided in the spherical surface 24, electrically conductive material 46 is formed on the side surfaces of the protrusions 42, and the electrically conductive material 46 formed on the side surfaces of the protrusions 42 is used as the conductive intersection surfaces 26.

Figure 20D:
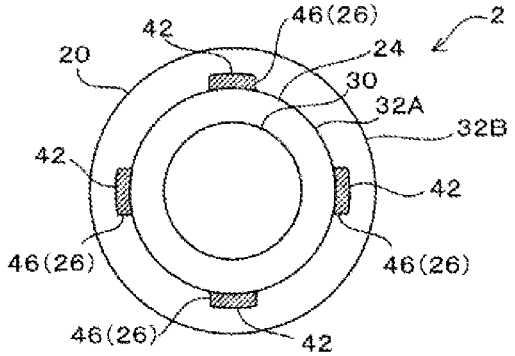

4) As illustrated in FIG. 20D, a configuration may be used in which one or more protrusions 42 formed from the electrically conductive material 46 are provided on the spherical surface 24, and the side surfaces of the protrusions are used as the conductive intersection surfaces 26.

Modified examples of the type described above provide the same effects as the first embodiment.

(Working Example 2)

Next, the results of other test examples on the golf ball 2 will be described.

Note that the test examples described below were performed on the golf ball 2 of a configuration illustrated in FIG. 22. The configuration of the above golf ball 2 is identical to that illustrated in FIG. 20D.

Figures 22, 23:
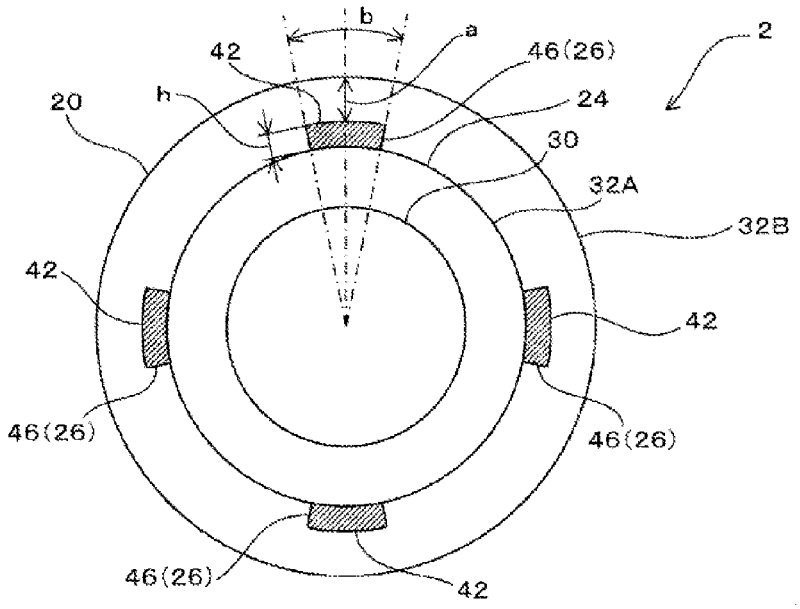
FIG. 22 is a cross-sectional view for describing dimensions of parts of the golf ball 2 in Working Example 2.
FIG. 23 is a table showing results of Test Examples 10 to 16 on Working Example 2.

Here, as illustrated in FIG. 22, a distance along the radial direction of the spherical body 20 between the protrusions 42 formed from the electrically conductive material 46 and the top surface of the second cover layer 32B was 1.3 mm.

The width of the protrusions (interval between the two opposing conductive intersection surfaces 26) was 5 mm.

As illustrated in FIG. 23, Test Example 10 corresponds to a comparative example in which the conductive intersection surfaces 26 were not formed in the golf ball 2.

In Test Example 11, the height h of the conductive intersection surfaces 26 along the radial direction of the spherical body 20 was 20 μm. 20 μm corresponds to the thickness of regular metal foil.

In Test Example 12, the height h was 150 μm. 150 μm corresponds to the thickness of a relatively thick coating film.

In Test Examples 13 to 16, the heights h were 300 μm, 500 μm, 900 μm, and 1500 μm.

The golf balls 2 configured as described above were launched at with a ball rotation speed adjusted to 5000 rpm (5000 revolutions per minute) using a golf ball launcher (launcher). In each test example, 100 measurements of the amount of spin were taken using a Doppler radar and a standard deviation in the amount of spin was calculated.

Then, assuming a standard deviation of 100 in Test Example 11, the reciprocal of the standard deviation in each test example was used to create an index.

In other words, for a standard deviation ½ of that in Test Example 11, the index would be 200. When the index was 200 or higher, 200 was recorded as the upper limit.

Note that in Test Example 10 for which the conductive intersection surfaces 26 was not formed, it was not possible to obtain a signal intensity distribution data Ps suitable for measuring the amount of spin and so the index for this experiment was not recorded in FIG. 23.

As illustrated in FIG. 23, when the height h of the conductive intersection surfaces 26 along the radial direction of the spherical body 20 was 150 μm or greater, the variation index for the amount of spin was 113 or higher. When the height h was 300 μm or greater, the variation index for the amount of spin was 200 or higher.

Hence, the height h of the conductive intersection surfaces 26 along the radial direction of the spherical body 20 is preferably 200 μm or greater, and more preferably 400 μm or greater.

Note that the upper limit on the height h of the conductive intersection surfaces 26 along the radial direction of the spherical body 20 can be appropriately determined according to the outer diameter of the various types of ball. For example, in the case of a golf ball, the outer diameter is approximately 43 mm and so the upper limit on the height h of the conductive intersection surfaces 26 along the radial direction of the spherical body 20 can be appropriately determined in accordance with this outer diameter.

Here, the arrangement, area, and the like of the conductive intersection surfaces 26 can be appropriately determined while taking into account the characteristics such as the flight characteristics, symmetry, and the like required for the golf ball.

Further as illustrated in FIG. 5, FIG. 6, FIG. 9, FIG. 10, FIG. 11, FIG. 12, and FIG. 13, in configurations in which the spherical surface 24 is formed with a smaller diameter than the diameter of the spherical body 20 and the conductive intersection surfaces 26 are formed on the outer side in the radial direction of the spherical surface 24, the entire area of the spherical surface not including the conductive intersection surfaces 26 may be a conductive spherical surface having conductivity.

Such an arrangement would advantageous from the perspective of ensuring the signal intensity in the frequency distribution DA illustrated in FIG. 3, as it would be possible to increase the intensity of the reflection wave W2 with the conductive spherical surface. Specifically, a larger peak (maximum value Dmax of signal intensity Ps) of the signal intensity distribution data P, as illustrated in FIG. 4, could be measured.

Thus, it is advantageous from the perspective of stably measuring the speed of travel of the golf ball 2 over a long period.

Further, although the embodiments described examples in which the a single annular body 28 or two annular bodies of first annular body 28A and second annular body 28B were provided, the number of annular bodies may be 3 or more.

Moreover, although the embodiments described examples in which the single groove 25 or two grooves of first groove 25A and second groove 25B were provided, the number of grooves may be 3 or more.

Furthermore, although the embodiments described golf balls 2 as the ball for a ball game, the present technology is not limited to golf balls 2, and can be widely applied to a variety of other conventional balls, such as hard baseballs, softballs, tennis balls, and soccer balls.

What is claimed is:

1. A ball for a ball game comprising: a spherical body; and an intersection surface that intersects with a spherical surface centered on a center of the spherical body, and is positioned inward of an outer surface of the spherical body, the intersection surface being formed as a conductive intersection surface having conductivity, a height of the conductive intersection surface along a radial direction of the spherical body being at least 200 μm.

2. The ball for a ball game according to claim 1, wherein the conductive intersection surface is formed to be continuous over an entire circumferential length of the spherical surface in a circumferential direction.

3. The ball for a ball game according to claim 1, wherein the spherical surface is formed to have a smaller diameter than a diameter of the spherical body, and the conductive intersection surface is formed on an outer side in a radial direction of the spherical surface.

4. The ball for a ball game according to claim 3, wherein an entire area of the spherical surface is formed as a conductive spherical surface having conductivity.

5. The ball for a ball game according to claim 1, wherein a first annular body formed from an electrically conductive material is protrudingly formed around an entire circumference of the spherical surface that intersects with a plane passing through a center of the spherical surface, and the conductive intersection surface is formed by both side surfaces of the first annular body.

6. The ball for a ball game according to claim 5, wherein at least one or more second annular bodies formed from an electrically conductive material are protrudingly formed around an entire circumference of the spherical surface that intersects with at least one or more planes that pass through the center of the spherical surface and are orthogonal to the plane, and the conductive intersection surface is formed by both side surfaces of the first and second annular bodies.

7. The ball for a ball game according to claim 1, wherein the spherical surface is formed to have a smaller diameter than a diameter of the spherical body, and the conductive intersection surface is formed on an inner side in a radial direction of the spherical surface.

8. The ball for a ball game according to claim 1, wherein a first groove is formed around an entire circumference of the spherical surface that intersects with a plane passing through a center of the spherical surface, a first annular body is formed by embedding electrically conductive material in the groove, and the conductive intersection surface is formed by both side surfaces of the first annular body.

9. The ball for a ball game according to claim 8, wherein a second groove is formed around an entire circumference of the spherical surface that intersects with at least one or more planes that pass through the center of the spherical surface and are orthogonal to the plane, at least one or more second annular bodies are formed by embedding electrically conductive material in the second annular body, and the conductive intersection surface is formed by both side surfaces of the first and second annular bodies.

10. The ball for a ball game according to claim 1, wherein the spherical body is configured by a spherical core layer positioned at the center of the spherical body and at least one or more cover layers that cover the core layer, and the spherical surface is a top surface of the core layer or a top surface of any one layer of the at least one or more cover layers.

11. The ball for a ball game according to claim 1, wherein the conductive intersection surface is formed in plurality at intervals in the circumferential direction of the spherical surface.

12. The ball for a ball game according to claim 11, wherein the spherical surface is formed to have a smaller diameter than a diameter of the spherical body, and the conductive intersection surface is formed on an outer side in a radial direction of the spherical surface.

13. The ball for a ball game according to claim 12, wherein an entire area of the spherical surface is formed as a conductive spherical surface having conductivity.

14. The ball for a ball game according to claim 11, wherein the spherical surface is formed to have a smaller diameter than a diameter of the spherical body, and the conductive intersection surface is formed on an inner side in a radial direction of the spherical surface.

15. The ball for a ball game according to claim 11, wherein the spherical body is configured by a spherical core layer positioned at the center of the spherical body and at least one or more cover layers that cover the core layer, and the spherical surface is a top surface of the core layer, or a top surface of any one layer of the at least one or more cover layers.

16. The ball for a ball game according to claim 1, wherein a plurality of recesses is formed in the spherical surface, electrically conductive material is formed on side surfaces of the recesses, and the conductive intersection surface is formed by the electrically conductive material formed on the side surfaces of the recesses.

17. The ball for a ball game according to claim 1, wherein a plurality of recesses is formed in the spherical surface, the recesses are filled with an electrically conductive material, and the conductive intersection surface is formed by side surfaces of the filled material.

18. The ball for a ball game according to claim 1, wherein a plurality of protrusions is formed on the spherical surface, electrically conductive material is formed on side surfaces of the protrusions, and the conductive intersection surface is formed by the electrically conductive material formed on side surfaces of the protrusions.

19. The ball for a ball game according to claim 1, wherein a plurality of protrusions formed from an electrically conductive material is formed on the spherical surface, and the conductive intersection surface is formed by side surfaces of the protrusions.

20. The ball for a ball game according to claim 1, wherein the conductive intersection surface is positioned on a plane that passes through the center of the spherical body.

* * * * *